US012092129B2

(12) United States Patent
Bredwad et al.

(10) Patent No.: US 12,092,129 B2
(45) Date of Patent: Sep. 17, 2024

(54) PUMP AND HYDRAULIC UNIT OF A PUMP

(71) Applicant: Xylem Europe GmbH, Schaffhausen (CH)

(72) Inventors: Viktor Bredwad, Spånga (SE); Stefan Ramström, Vallentuna (SE)

(73) Assignee: Xylem Europe GmbH, Schaffhausen (CH)

( * ) Notice: Subject to any disclaimer, the term of this patent is extended or adjusted under 35 U.S.C. 154(b) by 0 days.

(21) Appl. No.: 18/568,622

(22) PCT Filed: Jun. 7, 2022

(86) PCT No.: PCT/EP2022/065364
§ 371 (c)(1),
(2) Date: Dec. 8, 2023

(87) PCT Pub. No.: WO2022/258595
PCT Pub. Date: Dec. 15, 2022

(65) Prior Publication Data

US 2024/0271635 A1 Aug. 15, 2024

(30) Foreign Application Priority Data

Jun. 8, 2021 (EP) ..... 21178301

(51) Int. Cl.
*F04D 7/04* (2006.01)
*F04D 29/42* (2006.01)

(52) U.S. Cl.
CPC ..... *F04D 29/426* (2013.01); *F04D 7/04* (2013.01)

(58) Field of Classification Search
CPC ..... F04D 7/04; F04D 29/426; F04D 29/428
See application file for complete search history.

(56) References Cited

U.S. PATENT DOCUMENTS 10,837,456 B2 * 11/2020 Kawai ..... F04D 29/4273
10,895,267 B2 * 1/2021 Petit ..... F04D 1/04
(Continued)

FOREIGN PATENT DOCUMENTS

EP 1357294 A2 10/2003
EP 1899609 A1 3/2008
(Continued)

OTHER PUBLICATIONS

International Search Report and Written Opinion for International Application No. PCT/EP2022/065364, dated Aug. 23, 2022, 9 pages.

*Primary Examiner* — Eldon T Brockman
(74) *Attorney, Agent, or Firm* — Buchanan Ingersoll & Rooney PC

(57) ABSTRACT

A hydraulic unit of a pump for pumping liquid comprising solid matter, the hydraulic unit comprising a housing and an impeller seat, the housing having an axial inlet opening and an outlet opening, and the impeller seat having an axial inlet defined by an inlet wall. The impeller seat has an inlet radius (R) measured from an axially extending centre axis (A) to a circular intersection between the inlet wall and the upper surface of the impeller seat, and the impeller seat comprises a guide pin connected to and extending radially inwards from the inlet wall. The guide pin has a tip radius (r) measured from an axially extending centre axis (A) to the radially innermost part of the guide pin, and has a guide pin angle (μ) defined between a cut water line of a cut water and a radius of the impeller seat.

14 Claims, 6 Drawing Sheets

(56) References Cited

U.S. PATENT DOCUMENTS

| | | | | |
|---|---|---|---|---|
| 2018/0051708 | A1* | 2/2018 | Kawai | F04D 29/242 |
| 2019/0257320 | A1 | 8/2019 | Petit et al. | |
| 2022/0290695 | A1 | 9/2022 | Jaeger et al. | |
| 2023/0407878 | A1* | 12/2023 | Bredwad | F04D 7/045 |

FOREIGN PATENT DOCUMENTS

| | | | |
|---|---|---|---|
| EP | 3276177 | A1 | 1/2018 |
| EP | 3779201 | A1 | 2/2021 |

* cited by examiner

PUMP AND HYDRAULIC UNIT OF A PUMP

CROSS-REFERENCE TO RELATED APPLICATIONS

This is the U.S. National Phase of International Application No. PCT/EP2022/065364, filed Jun. 7, 2022, which claims priority to European Application No. 21178301.4, filed Jun. 8, 2021. The disclosure of each of these applications is incorporated herein by reference in its entirety for all purposes.

TECHNICAL FIELD OF THE INVENTION

The present invention relates generally to the field of pumps configured to pump liquid comprising solid matter. Further, the present invention relates to the field of submergible pumps, such as sewage/wastewater pumps, especially configured to pump liquid such as sewage/wastewater that may comprise polymers, hygiene articles, fabrics, rags, disposable gloves, face masks, etc. The present invention relates specifically to a hydraulic unit for said pumps and applications, and to a pump comprising such a hydraulic unit and an open impeller. The hydraulic unit of a pump comprises an impeller seat is also known under the terms suction cover and inlet insert/plate.

In accordance with a first aspect, the present invention relates to a hydraulic unit comprising a housing that defines a volute and an impeller seat located in said volute, said housing having an axial inlet opening and an outlet opening and said impeller seat having an axial inlet defined by an inlet wall, wherein the impeller seat has an inlet radius (R) measured from an axially extending centre axis (A) to the circular intersection between the inlet wall and the upper surface of the impeller seat. The impeller seat further comprises a guide pin connected to and extending radially inwards from said inlet wall, the guide pin having a tip radius (r) measured from the axially extending centre axis (A) to the radially innermost part of the guide pin, wherein an imaginary 15%-circle is offset radially inwards from said circular intersection fifteen percent of the difference between said inlet radius (R) and said tip radius (r). The housing further comprises a cut water, wherein a cut water line is a radius of the impeller seat tangent to the most downstream point of the cut water, seen in the direction of rotation of the pump.

In accordance with a second aspect, the present invention relates to a pump for pumping liquid comprising solid matter, the pump comprising an open impeller having a cover plate, a centrally located hub and at least two spirally swept blades connected to the cover plate and to the hub, wherein each blade of the impeller comprises a leading edge adjacent the hub and a trailing edge at the periphery of the impeller and a lower edge, wherein the lower edge extends from the leading edge to the trailing edge and separates a suction side of the blade from a pressure side of the blade.

BACKGROUND OF THE INVENTION

In sewage/wastewater treatment plants, septic tanks, wells, pump stations, etc., it occurs that solid matter/contaminations such as socks, sanitary towels, papers, disposable diapers, disposable gloves, face masks, rags, etc. obstruct the pump that is submerged in the basin/tank, i.e. socalled hard clog of the pump. This means that solid matter has entered the pump inlet and prevents the impeller from rotating. Thus, the pump is jammed by some solid matter being wedged between the impeller and the pump housing/impeller seat.

When the impeller and the impeller seat are positioned at a fixed distance from each other, the pollutants are sometimes too large to simply pass through the pump. Large pieces of solid matter may in worst case cause the impeller to become wedged, thus seriously damaging the pump, such as bearings and drive unit. Such an unintentional shutdown is costly since it entails expensive, tedious and unplanned maintenance work.

European patent EP 1357294 discloses a pump that comprises an impeller that is arranged to rotate in the volute of the pump, said impeller being suspended by a drive shaft, and the pump comprises an impeller seat having a guide pin and a feeding groove. The impeller is located at a fixed distance in the axial direction in relation to the impeller seat. The guide pin is connected to the inlet wall of the impeller seat and extends straight towards the centre of the impeller and towards the centre of the impeller seat.

European patent EP 1899609 discloses a pump that partly solves the problem of fixed distance between the impeller seat and the impeller. The pump comprises an impeller that is arranged to rotate in the volute of the pump, said impeller being suspended by a drive shaft, and the pump comprises an impeller seat having a guide pin and a feeding groove. The impeller is displaceable in the axial direction in relation to the impeller seat during operation of the pump in order to allow larger pieces of solid matter to pass through, contaminations that otherwise would risk to block the pump or wedge the impeller. The guide pin is connected to the inlet wall of the impeller seat and extends towards the centre of the impeller and towards the centre of the impeller seat. The impeller is displaced by the solid matter when the solid matter enters the gap between the leading edge of the blade and the guide pin and/or the gap between the lower edge of the blade and the upper surface of the impeller seat.

Such pumps and applications are also protected by suitable monitoring and control units that monitors the operation of the pump and controls the operation of the pump based thereon. For instance, when the rotational speed of the impeller decreases and/or the power consumption increased the guide pin and/or the volute of the impeller is partly clogged and the monitoring and control unit enters a cleaning sequence that comprises the step of rotating the impeller in the backward direction, i.e. opposite the direction of rotation of the impeller during normal operation of the pump.

Many known pumps comprising a guide pin and a feeding groove has the guide pin located opposite the cut water in relation to the centre axis of the pump, such that the outlet of the feeding groove is located close to the outlet of the pump, and thereto the cut water is located upstream the outlet of the pump, seen in the direction of rotation of the pump, in order to obtain an as little redirection of the flow as possible from the spirally shaped portion of the volute to the outlet of the pump. It is also known to have the centre of the guide pin located in line with the outlet of the pump in order to have the outlet of the feeding groove located early in the spirally shaped portion of the volute, seen in the direction of rotation of the pump.

However, the inventor has identified that solid matter, especially solid matter having elongated shape and/or long fibres and/or comprises elastic and durable components, tends to get caught over the cut water and will block/clog the pump and have negative effect on the pumped flow, i.e. the efficiency of the pump.

Thereby more solid matter risk to accumulate in the volute and at the inlet of the pump, i.e. the risk for severe clogging of the pump is increasing rapidly. Such an unintentional shutdown, when the pump is stopped and requires maintenance/repair, is costly since it entails expensive, tedious and unplanned maintenance work, and thereto the pump station risk to become flooded due to reduced efficiency of a partly clogged/blocked pump.

OBJECT OF THE INVENTION

The present invention aims at obviating the aforementioned disadvantages and failings of previously known impeller seats and pumps, and at providing an improved hydraulic unit and pump.

A primary object of the present invention is to provide an improved hydraulic unit and pump of the initially defined type that reduces the risk of having solid matter caught over the cut water, and thereby reduces or prevents blockage/clogging and avoid reduced efficiency of the pump.

It is also an object of the present invention to provide an improved hydraulic unit and pump of the initially defined type, wherein said pump in a more reliable manner allows solid matter to pass through the pump without disintegrating the solid matter.

SUMMARY OF THE INVENTION

According to the invention at least the primary object is attained by means of the initially defined hydraulic unit and pump having the features defined in the independent claims. Preferred embodiments of the present invention are further defined in the dependent claims.

According to a first aspect of the present invention, there is provided a hydraulic unit of the initially defined type, which is characterized in that the cut water line is located downstream a radius of the impeller seat that is perpendicular to the outlet opening, seen in the direction of rotation of the pump, and in that a guide pin angle (p) between the cut water line and a radius of the impeller seat intersecting a leading edge of the guide pin at the 15%-circle, seen in the direction of rotation of the pump, is equal to or more than 3 degrees and equal to or less than 25 degrees.

According to a second aspect of the present invention, there is provided a pump of the initially defined type, which is characterized in that the pump comprises such a hydraulic unit, wherein the leading edge of the blade is configured to cooperate with the guide pin of the impeller seat during operation of the pump and wherein the lower edge of the blade is located opposite the upper surface of the impeller seat.

Thus, the present invention is based on the insight of the inventors that it is advantageous to have the cut water located downstream the outlet of the pump in order to reduce the risk of having solid matter caught over the cut water when the solid matter is on its way to leave the volute together with the redirected liquid flow, and further advantageous to also have the leading edge of the guide pin located downstream the cut water such that solid matter scraped off by the leading edge of the guide pin is not caught over the cut water when the solid matter travels from the inlet towards the wall of the volute.

According to various embodiments of the present invention, a cut water line angle ($\alpha$) between the cut water line and the radius of the impeller seat that is perpendicular to the outlet opening, seen in the direction of rotation of the pump, is more than 0 degrees and equal to or less than 20 degrees.

According to various embodiments of the present invention, the guide pin angle ($\mu$) is preferably equal to or less than 20 degrees, and most preferably equal to or less than 15 degrees.

According to various embodiments of the present invention, the impeller seat comprises a feeding groove arranged in the upper surface of the impeller seat and extending from the inlet wall to the periphery of the impeller seat. Thereby the solid matter scraped off from the leading edge of the blade of the impeller by the leading edge of the guide pin, is guided towards the wall of the pump housing downstream the cut water, seen in the direction of rotation of the pump.

According to various embodiments of the present invention, said feeding groove has a groove inlet at the inlet wall of the impeller seat, said groove inlet having an upstream edge at said circular intersection, wherein the upstream edge of the groove inlet is located upstream a radius of the impeller seat intersecting an upstream edge of the guide pin at the 15%-circle, seen in the direction of rotation of the pump. Thereto a groove outlet at the periphery of the impeller seat is preferably located downstream the guide pin, seen in the direction of rotation of the pump. Thereby the solid matter scraped off from the leading edge of the blade of the impeller by the leading edge of the guide pin, is guided further towards the wall of the pump housing downstream the cut water, seen in the direction of rotation of the pump According to various embodiments of the present invention, the feeding groove has a groove inlet at the inlet wall of the impeller seat, said groove inlet having a downstream edge at said circular intersection, wherein the downstream edge of the groove inlet s located downstream a radius of the impeller seat intersecting an upstream edge of the guide pin at the 15%-circle, seen in the direction of rotation of the pump.

According to various embodiments of the present invention, the impeller is displaceable back and forth in the axial direction in relation to the impeller seat during operation of the pump. Thanks to the mutual location of the outlet, cut water and leading edge of the guide pin, solid matter that displaces the impeller away from the impeller seat and moves towards the wall of the pump housing before the groove outlet, will still not risk to get caught over the cut water.

Further advantages with and features of the invention will be apparent from the other dependent claims as well as from the following detailed description of preferred embodiments.

BRIEF DESCRIPTION OF THE DRAWINGS

A more complete understanding of the abovementioned and other features and advantages of the present invention will be apparent from the following detailed description of preferred embodiments in conjunction with the appended drawings, wherein.

DETAILED DESCRIPTION OF PREFERRED EMBODIMENTS OF THE INVENTION

The present invention relates specifically to the field of submergible pumps especially configured for pumping liquid comprising solid matter, such as sewage/wastewater pumps. Such pumps are configured to pump liquid such as sewage/wastewater that may comprise polymers, hygiene articles, fabrics, rags, disposable gloves, face masks, etc., i.e. solid matter comprising elastic and durable components. The present invention relates specifically to a hydraulic unit suitable for said pumps and applications. The present invention is also suitable wherein the pumped media comprises long fibers, such as hair, pieces of textile and the like.

Figure 1:
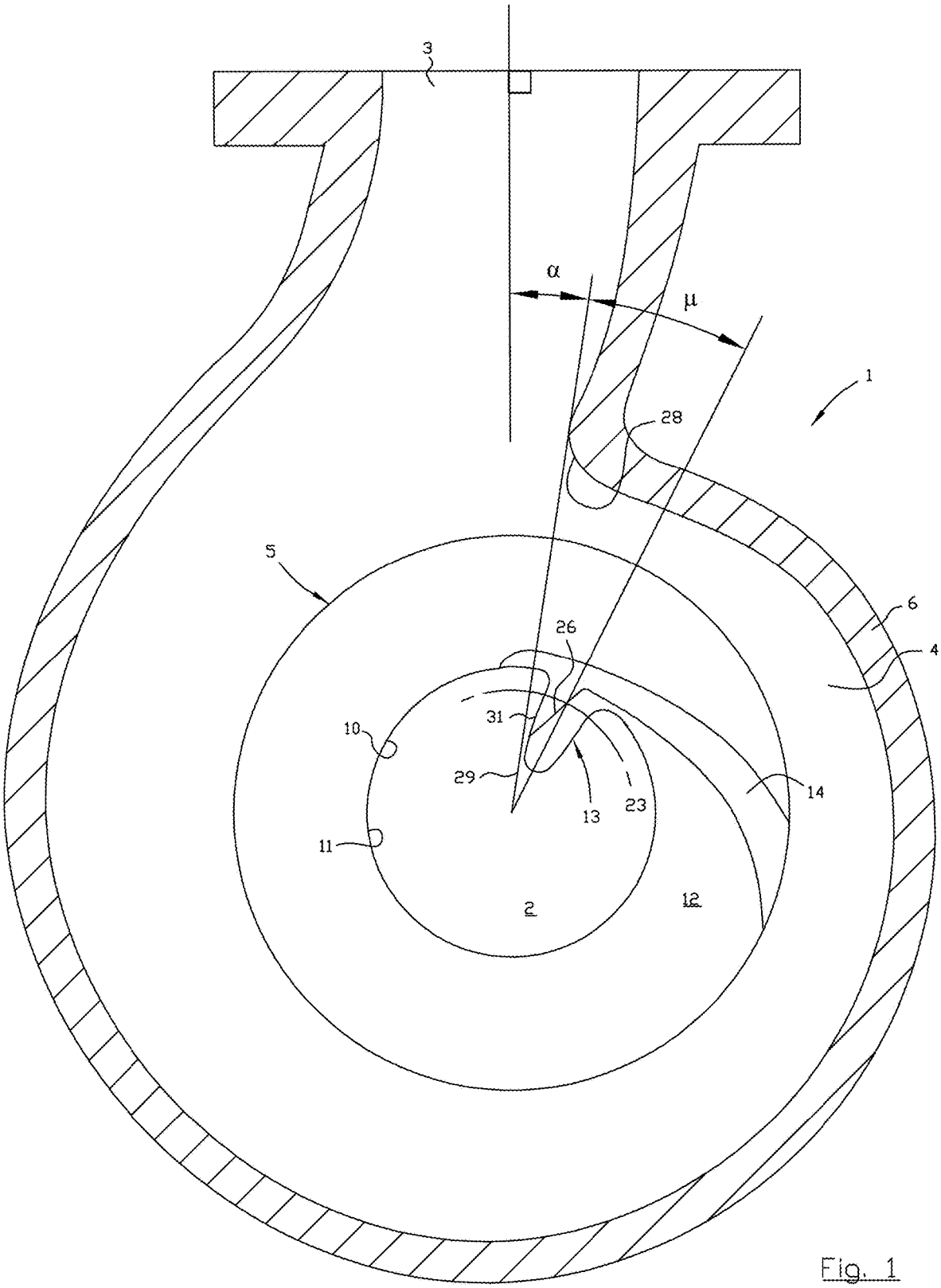
FIG. 1 is a schematic cross-sectional view from above of the inventive hydraulic unit, i.e. disclosing the housing of the pump and the impeller seat.
Figure 2:
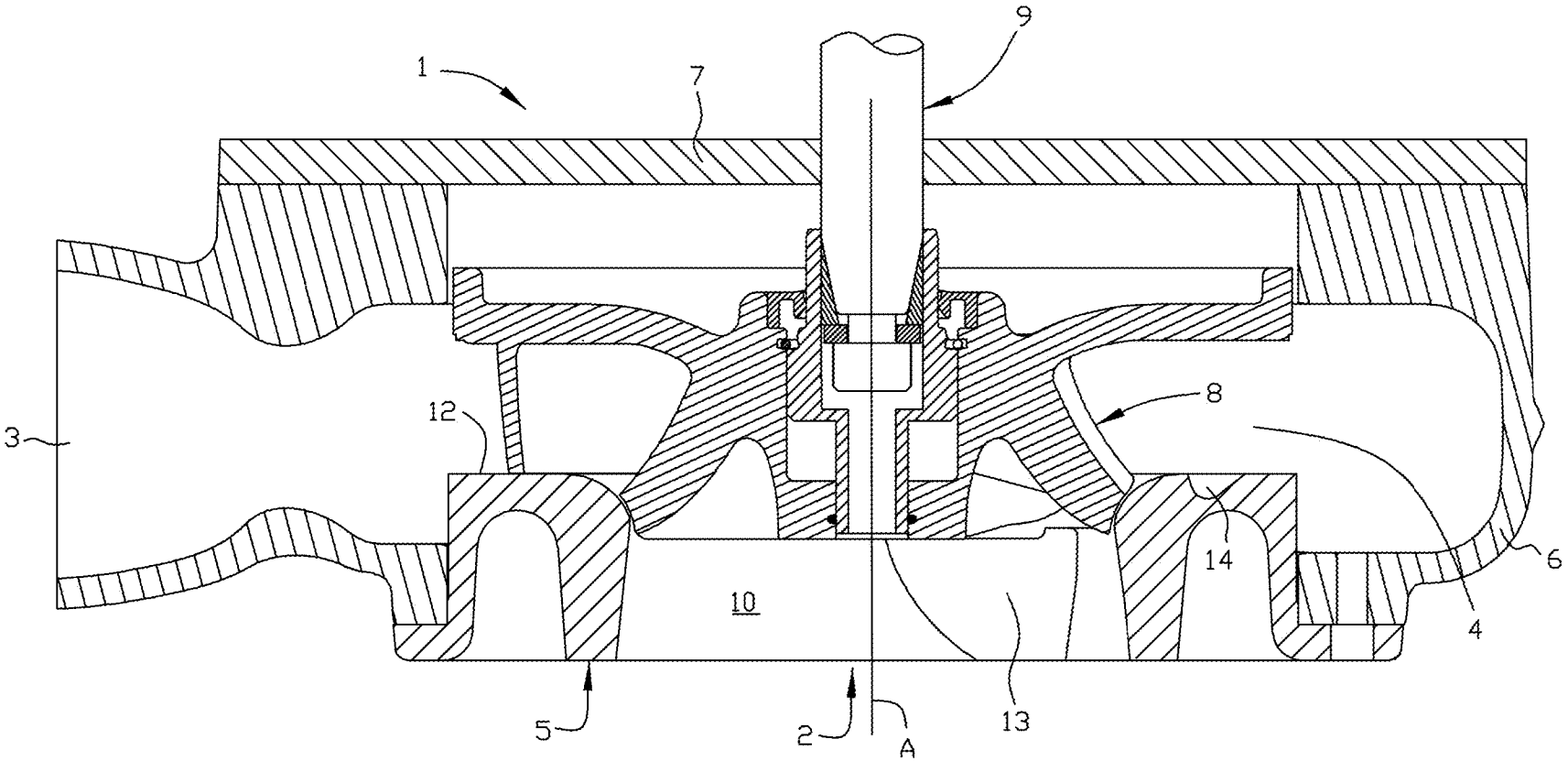
FIG. 2 is a schematic cross-sectional side view of a part of an inventive pump, i.e. a submersible wastewater pump, comprising an inventive hydraulic unit and an open impeller.
Figure 3:
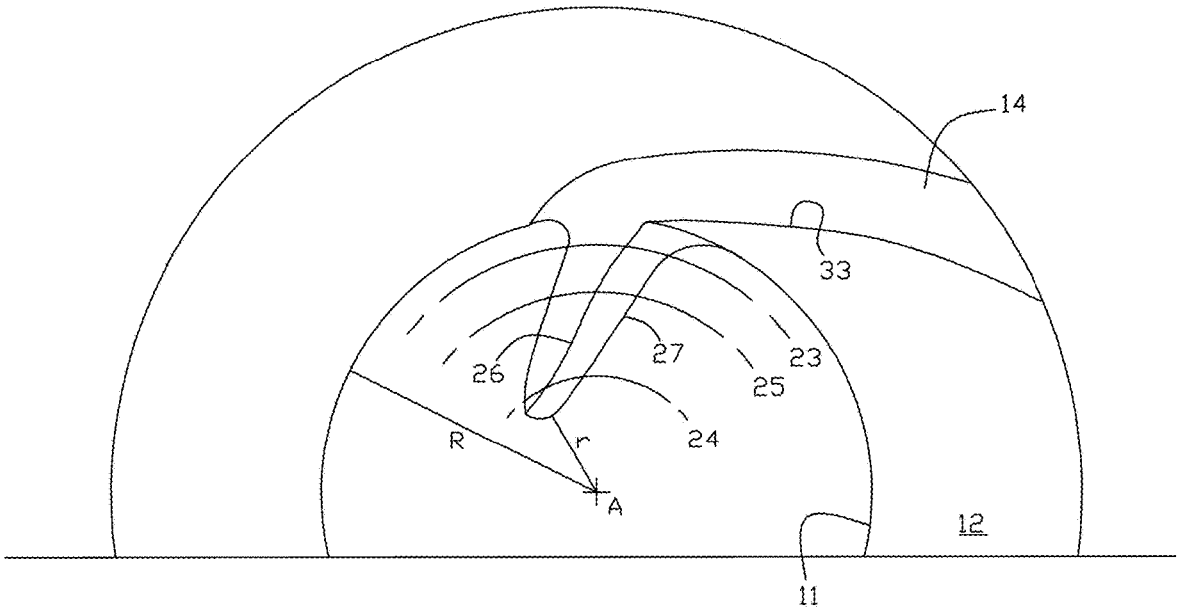
FIG. 3 is a schematic view from above of a part of the impeller seat according to the first embodiment.

Reference is initially made to FIGS. 1 and 2, disclosing a schematic illustration of a hydraulic unit of a pump, generally designated 1. A general submergible pump will be described with reference to FIG. 2, and the submergible pump 1 is hereinafter referred to as pump.

The hydraulic unit of the pump 1 comprises an inlet 2, an outlet 3 and a volute 4 located intermediate said inlet 2 and said outlet 3, i.e. the volute 4 is located downstream the inlet 2 and upstream the outlet 3. The volute 4 is partly delimited by an impeller seat, generally designated 5, that encloses the inlet 2 and a housing 6. The volute 4 is also delimited by an intermediate wall 7 separating the volute 4 from the drive unit (removed from FIG. 2) of the pump 1. Said volute 4 is also known as pump chamber and said impeller seat 5 is also known as suction cover or wear plate or inlet insert/plate.

In some applications, the outlet of the hydraulic unit also constitutes the outlet 3 of the pump 1, and in other applications the outlet of the hydraulic unit is connected to a separate outlet 3 of the pump 1. The outlet 3 of the pump 1 is configured to be connected to an outlet conduit (not shown). Thereto the pump 1 comprises an open impeller, generally designated 8, wherein the impeller 8 is located in the volute 4, i.e. the hydraulic unit of the pump 1 comprises an impeller 8.

The drive unit of the pump 1 comprises an electric motor arranged in a liquid tight pump housing, and a drive shaft 9 extending from the electric motor through the intermediate wall 7 and into the volute 4. The impeller 8 is connected to and driven in rotation by the drive shaft 9 during operation of the pump 1, wherein liquid is sucked into said inlet 2 and pumped out of said outlet 3 by means of the rotating impeller 8 when the pump 1 is active. The pump housing 6, the impeller seat 5, the impeller 8, and other essential components, are preferably made of metal, such as aluminum and steel. The electric motor is powered via an electric power cable extending from a power supply, and the pump 1 comprises a liquid tight lead-through receiving the electric power cable.

According to preferred embodiments, the pump 1, more precisely the electric motor, is operatively connected to a control unit, such as an Intelligent Drive comprising a Variable Frequency Drive (VFD). Thus, said pump 1 is configured to be operated at a variable operational speed [rpm], by means of said control unit. According to preferred embodiments, the control unit is located inside the liquid tight pump housing, i.e. it is preferred that the control unit is integrated into the pump 1. The control unit is configured to control the operational speed of the pump 1. According to alternative embodiments the control unit is an external control unit, or the control unit is separated into an external sub-unit and an internal sub-unit. The operational speed of the pump 1 is more precisely the rpm of the electric motor and of the impeller 8 and correspond/relate to a control unit output frequency. The control unit is configured and capable of operating the pump 1 and impeller 8 in a normal direction of rotation, i.e. forward, in order to pump liquid, and in an opposite direction of rotation, i.e. backwards, in order to clean or unblock the pump 1 and impeller 8.

The components of the pump 1 are usually cold down by means of the liquid/water surrounding the pump 1. The pump 1 is designed and configured to be able to operate in a submerged configuration/position, i.e. during operation be located entirely under the liquid surface. However, it shall be realized that the submersible pump 1 during operation must not be entirely located under the liquid surface but may continuously or occasionally be fully or partly located above the liquid surface. In dry installed applications the submergible pump 1 comprises dedicated cooling systems.

The present invention is based on a new and improved configuration of the hydraulic unit, that is configured to be used in pumps 1 suitable for pumping liquid comprising solid matter, for instance wastewater/sewage comprising long fibers and elastic/durable components that risk to clog and block the pump 1. When solid matter clog/block the pump 1 the torque and consumed power increases and in order not to strain the pump 1, the control unit may enter a cleaning sequence whereupon the impeller 8 is rotating backwards for a short period of time. If such backward operation, one or several attempts, is not sufficient, maintenance staff need to visit the pump station and manually clean/service the pump 1.

According to various embodiments the impeller 8 is displaceable back and forth in the axial direction in relation to the impeller seat 5 during operation of the pump 1, in order to let larger pieces of solid matter pass through the volute 4 of the pump 1.

The axial inlet of the impeller seat 5 is defined by an inlet wall 10, wherein the impeller seat 5 has an inlet radius (R) measured from an axially extending centre axis (A) to the circular intersection 11 between the inlet wall 10 and an upper surface 12 of the impeller seat 5.

The inlet wall 10 is more or less cylindrical or slightly conical having a decreasing flow area in the downstream direction, i.e. upwards in FIG. 2. The upper surface 12 of the impeller seat 5 is the surface that is seen from above, i.e. FIG. 1, and the circular intersection 11 is the plane of the impeller seat 5 having the smallest flow area, i.e. the transition between the inlet wall 10 and the upper surface 12. The upper surface 12 may comprise a flat section 12' and an arc-shaped section 12", wherein the flat section 12' may be located in a horizontal plane or be tilted inwards/downwards and the arc-shaped section 12" interconnects the flat section 12' and the inlet wall 10. According to various embodiments the upper surface 12 only comprises an arc-shaped section 12" extending all the way from the inlet wall 10 to the periphery of the impeller seat 5. According to other various embodiments the upper surface 12 only comprises a flat section 12' extending all the way from the inlet wall 10 to the periphery of the impeller seat 5.

Said impeller seat 5 comprises a guide pin 13 connected to and extending radially inwards from said inlet wall 10, the guide pin 13 having a tip radius (r) measured from the axially extending centre axis (A) to the radially innermost part of the guide pin 13. The main function of the guide pin 13 is to scrape off solid matter from the impeller 8 and feed the solid matter outwards, during normal operation of the pump 1.

According to various embodiments, said impeller seat 5 also comprises a feeding groove 14 arranged in the upper surface 12 of the impeller seat 5 and extending from the inlet wall 10 to the periphery of the impeller seat 5. An inlet of the feeding groove 14 is located adjacent the guide pin 13. The feeding groove 14 is preferably swept/curved in the direction of rotation of the pump 1, more precisely the direction of rotation of the impeller 8, seen from the inlet wall 10 towards the periphery. Part of the inlet of the feeding groove 14 may be arranged in the inlet wall 10 of the impeller seat 5. The function of the feeding groove 14 is to feed the solid matter outwards towards the wall of the housing 6, during normal operation of the pump 1, in cooperation with the impeller 8.

Figure 9:
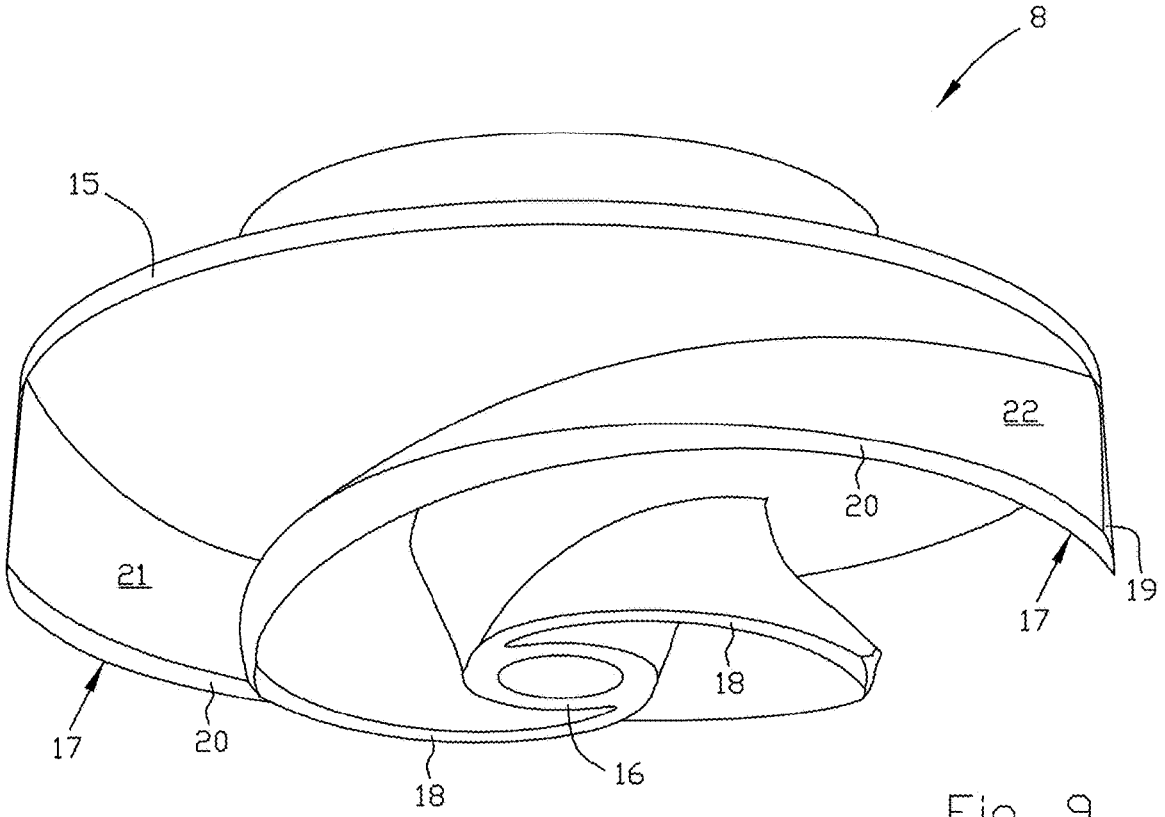
FIG. 9 is a schematic perspective view from below of an open impeller.
Figure 10:
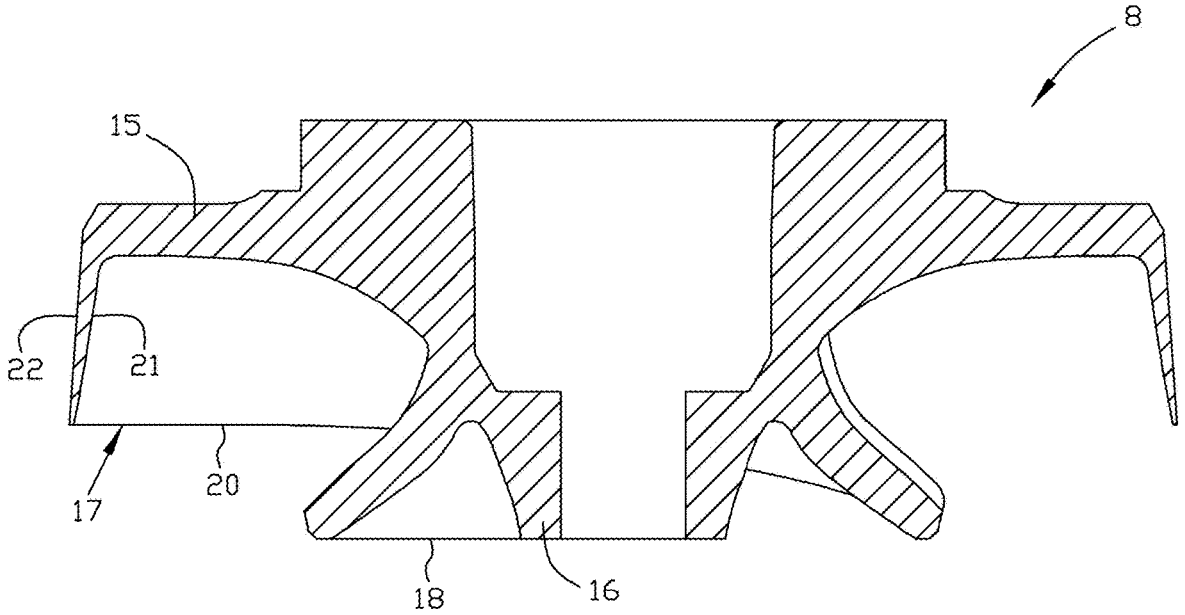
FIG. 10 is a schematic cross-sectional side view of the impeller according to FIG. 9.

Reference is now made to FIGS. 9 and 10 disclosing the open impeller 8. The impeller 8 comprises a cover plate 15, a centrally located hub 16 and at least two spirally swept blades 17 connected to the cover plate 15 and to the hub 16. The blades 17 are equidistant located around the hub 16. The blades 17 are also known as vanes, and the cover plate 15 is also known as upper shroud.

The blades 17 are swept/curved, seen from the hub 16 towards the periphery of the impeller 8, in a direction opposite the direction of rotation of the impeller 8 during normal (liquid pumping) operation of the pump 1. Thus, seen from below, i.e. FIG. 9, the direction of rotation of the impellers 8 during normal operation is counterclockwise.

Each blade 17 comprises a leading edge 18 adjacent the hub 16 and a trailing edge 19 at the periphery of the impeller 8. The leading edge 18 of the impeller 8 is located upstream the trailing edge 19, wherein two adjacent blades 17 together defines a channel extending from the leading edges 18 to the trailing edges 19. The leading edge 18 is located at the inlet of the impeller seat 5, and the leading edge 18 is spirally swept from the hub outwards, in the same direction as the sweep of the blade 17. During operation, the leading edges 18 grabs hold of the liquid, the channels accelerate and/or add pressure to the liquid, and the liquid leaves the impeller 8 at the trailing edges 19. Thereafter the liquid is guided by the volute 4 of the hydraulic unit towards the outlet 3. Thus, the liquid is sucked to the impeller 8 and pressed out of the impeller 8. Said channels are also delimited by the cover plate 15 of the impeller 8 and by the impeller seat 5. The diameter of the impeller 8 and the shape and configuration of the channels/blades determines the pressure build up in the liquid and the pumped flow.

Each blade 17 also comprises a lower edge 20, wherein the lower edge 20 extends from the leading edge 18 to the trailing edge 19 and separates a suction side/surface 21 of the blade 17 from a pressure side/surface 22 of the blade 17. The lower edge 20 is configured to be facing and located opposite the impeller seat 5 of the pump 1. Thus, the suction side 21 of one blade 17 is located opposite the pressure side 22 of an adjacent blade 17. The leading edge 18 and the trailing edge 19 also separates the suction side 21 from the pressure side 22. The leading edge 18 is preferably rounded. The lower edge 20 of the blade 17 is connected to the leading edge 18 at a location corresponding to the circular intersection 11 of the impeller seat 5.

Figure 4:
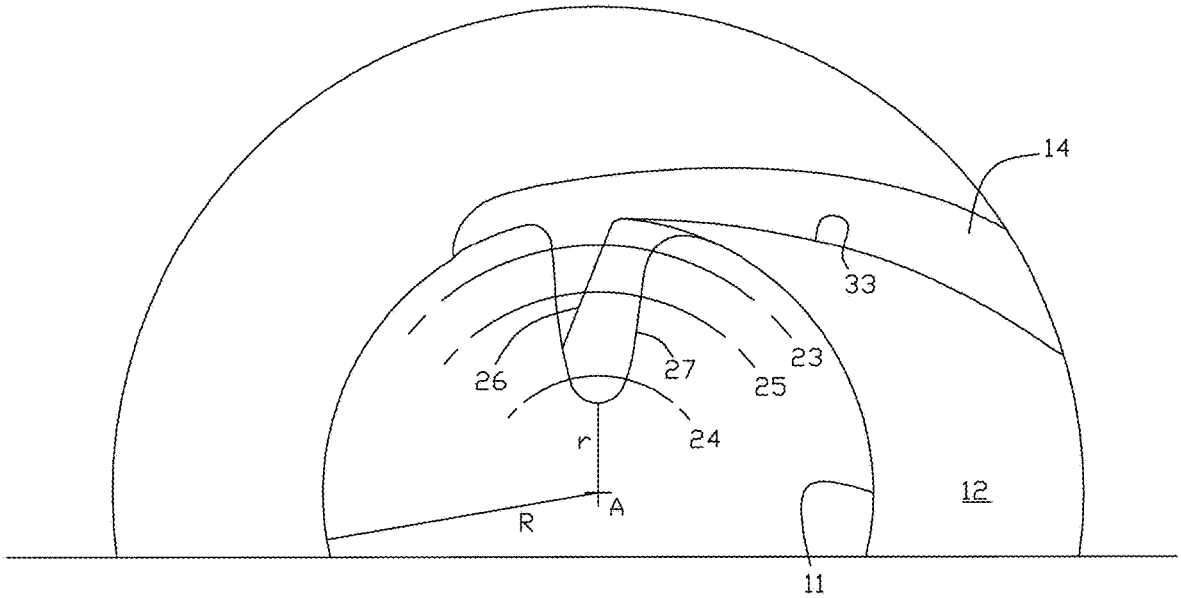
FIG. 4 is a schematic view from above of a part of an impeller seat according to the second embodiment.
Figure 5:
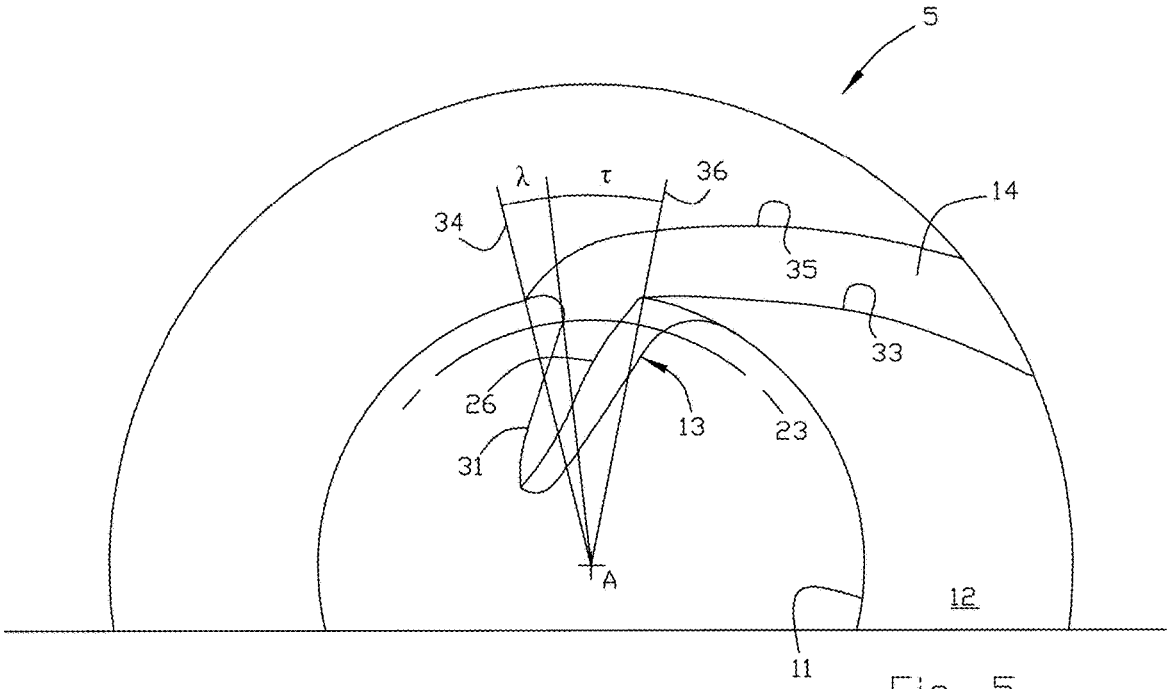
FIG. 5 is a schematic view from above of a part of the impeller seat according to FIG. 3 disclosing a groove inlet upstream edge angle (A) and a groove inlet downstream edge angle (T)
Figure 6:
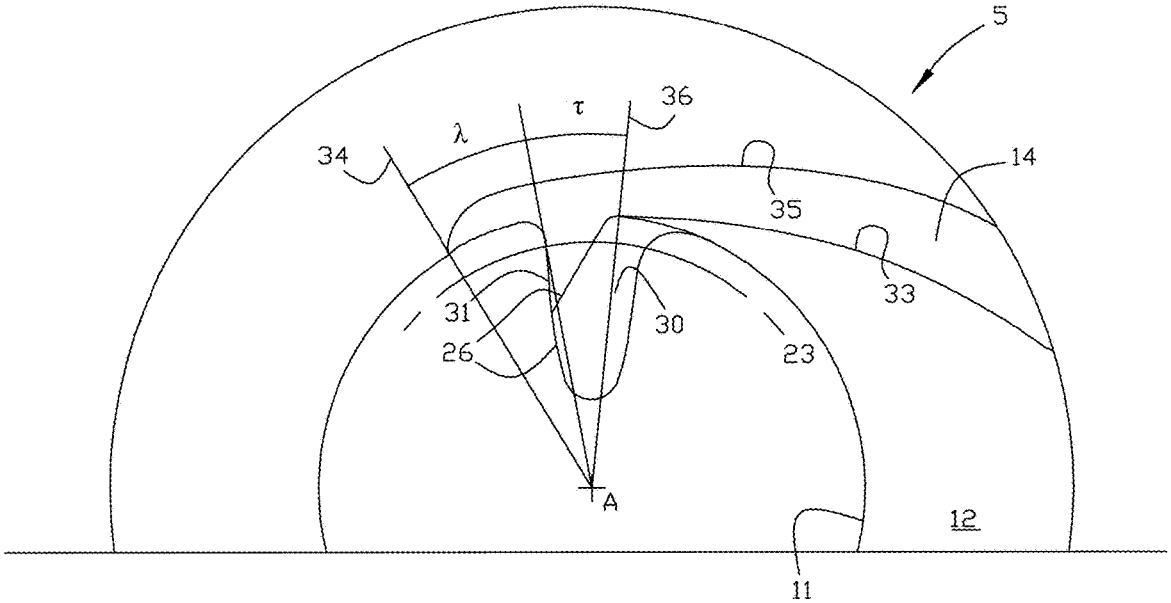
FIG. 6 is a schematic view from above of a part of the impeller seat according to FIG. 4 disclosing a groove inlet upstream edge angle (A) and a groove inlet downstream edge angle (T)
Figure 7:
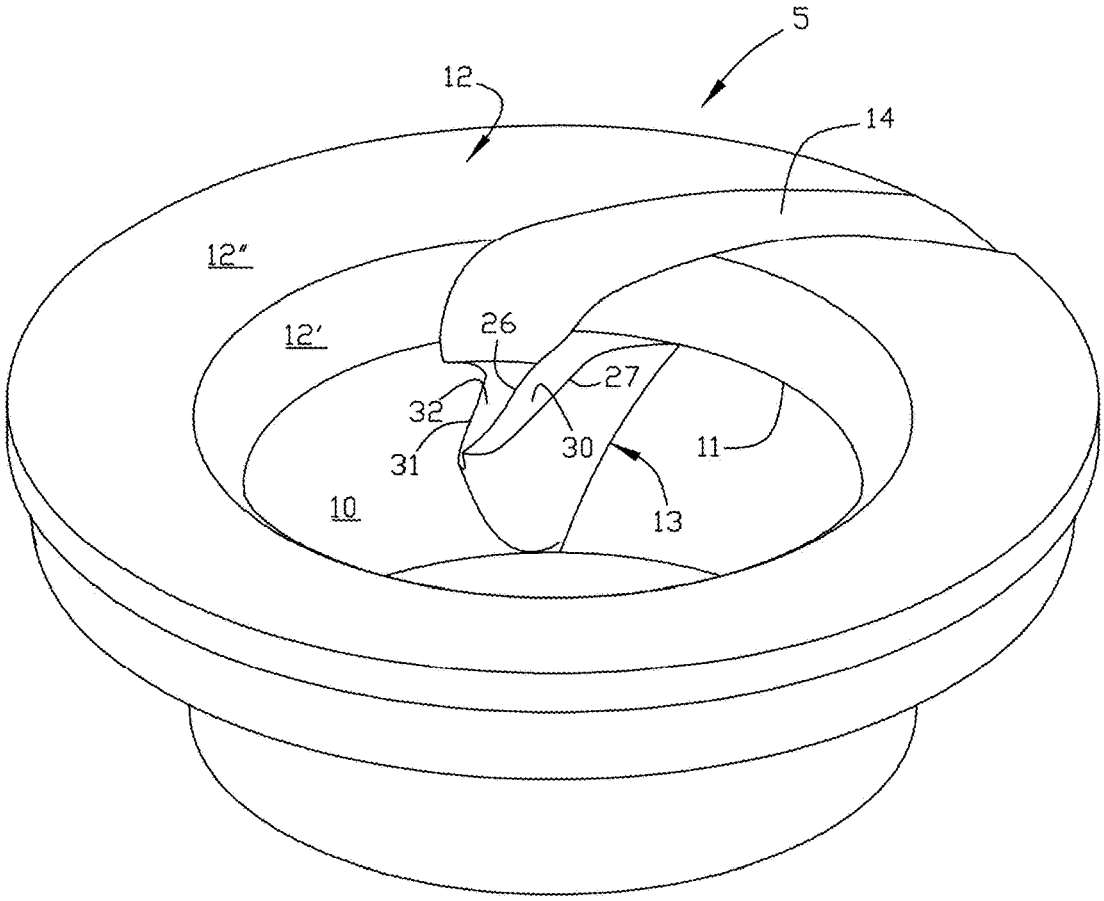
FIG. 7 is a schematic perspective view from above of the impeller seat according to FIG. 3.
Figure 8:
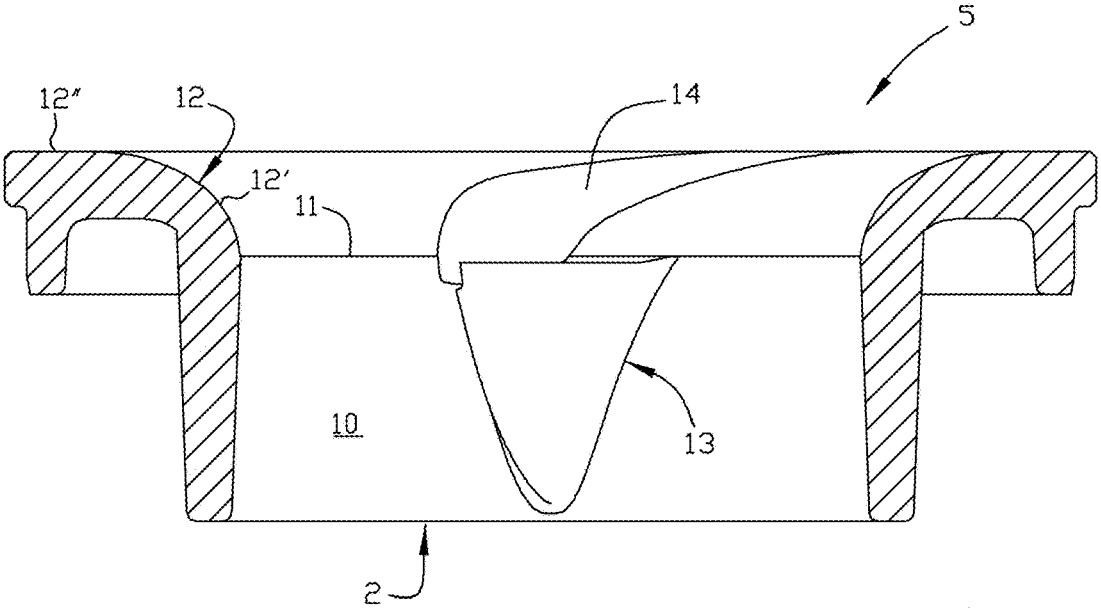
FIG. 8 is a schematic cross-sectional side view of the impeller seat according to FIG. 3.

Reference is now made to FIGS. 3-8, wherein FIGS. 3, 5 and 7-8 disclose an impeller seat according to a first embodiment and FIGS. 1, 4 and 6 disclose an impeller seat 5 according to a second embodiment. The first and second embodiment are alike if nothing else is indicated, and it shall be pointed out that the present invention is not limited to these illustrative embodiments of the impeller seat 5.

The present invention is based on a new configuration of the hydraulic unit, and in order to define this new configuration the design of the guide pin 13 and the feeding groove 14 are defined using imaginary circles, wherein an imaginary 15%-circle, denoted 23, is offset radially inwards from said circular intersection 11 fifteen percent of the difference between said inlet radius (R) and said tip radius (r), and wherein an imaginary 85%-circle, denoted 24, is offset radially inwards from said circular intersection 11 eighty-five percent of the difference between said inlet radius (R) and said tip radius (r). Thereto, an imaginary 40%-circle, denoted 25, is defined that is offset radially inwards from the circular intersection 11 forty percent of the difference between the inlet radius (R) and the tip radius (r). Said 15%-circle and said 85%-circle are used since the impeller seat 5 comprises a rounded transition between the guide pin 13 and the inner wall 10 and comprises a rounded tip, and thereby the shape of the innermost and outermost parts of the guide pin 13 are disregarded when defining the overall shape of the guide pin 13. The guide pin 13 comprises a leading edge 26 and a trailing edge 27. According to various embodiments, the leading edge 26 of the guide pin 13 is principally straight between the 15%-circle 23 and the 40%-circle 25.

Reference is now made to FIG. 1, the housing 6 of the pump 1 further comprises a cut water 28, also known as tongue, wherein a cut water line 29 is a radius of the impeller seat 5 tangent to the most downstream point of the cut water 28, seen in the direction of rotation of the pump 1. It is essential that the cut water line 29 is located downstream a radius of the impeller seat 5 that is perpendicular to the outlet opening 3, seen in the direction of rotation of the pump 1.

According to various embodiments a cut water line angle ($\alpha$) between the cut water line 29 and the radius of the impeller seat 5 that is perpendicular to the outlet opening 3, seen in the direction of rotation of the pump 1, is more than 0 degrees and equal to or less than 20 degrees. A too large cut water line angle ($\alpha$), i.e. more than the preferred 20 degrees, entails that the circumferential length of the volute 4, i.e. the part adding pressure to the pumped liquid, gets too small/short.

It is also essential that that a guide pin angle ($\mu$) between the cut water line 29 and a radius of the impeller seat 5 intersecting a leading edge 26 of the guide pin 13 at the 15%-circle 23, seen in the direction of rotation of the pump 1, is equal to or more than 3 degrees and equal to or less than 25 degrees.

A too small guide pin angle ($\mu$), i.e. less than 3 degrees, the risk of having solid matter caught over the cut water 28 increases rapidly. A too large guide pin angle ($\mu$), i.e. more than 25 degrees, entails that large pieces of solid matter is transported to the outer part of the volute 4 late and runs the risk of getting caught over the cut water 28.

According to a preferred embodiment the guide pin angle (μ) is equal to or more than 3 degrees and equal to or less than 20 degrees, and according to a more preferred embodiment the guide pin angle (μ) is equal to or more than 3 degrees and equal to or less than 15 degrees.

According to various embodiments, the guide pin 13, at least between the inlet wall 10 and the 40%-circle 25, comprises a pre-leading edge 31 located upstream the leading edge 26 of the guide pin 13, seen in the direction of rotation of the pump 1 and seen in the axial direction. See especially FIGS. 5-7.

According to various embodiments, such as the first embodiment of the impeller seat 5, the pre-leading edge 31 is located upstream the leading edge 26 at least between the inlet wall 10 and the 85%-circle 24. Thus, the guide pin 13 comprises a step-like or wedged recess-configuration at the upstream part of the guide pin 13, seen in the direction of rotation of the impeller 8. Thereby, solid matter will more easily get scraped off from the impeller 8, and in embodiments having an axially displaceable impeller 8 the solid matter will more easily enter into the gap between the guide pin 13 and the leading edge 18 of the blade 17 and thereby displace the impeller 8. Thus, the time needed for passing through solid matter is considerably reduced, i.e. the scraping off is more effective at the same time as the scraping off is more efficient.

According to various embodiments the axial distance between the pre-leading edge 31 and the leading edge 26 of the guide pin 13 is more than 1 mm and equal to or less than 4 mm. A too small axial distance the solid matter will not enter the gap and a too big axial distance the effect of displacing the impeller 8 in the axial direction will be reduced. Thus, the stepwise configuration of the guide pin 13 will increase the probability that the solid matter will more easily enter the axial gap between the guide pin and the leading edge of the blade and enter the inlet of the feeding groove 14.

According to various embodiments, the leading edge 26, at least between the inlet wall 10 and the imaginary 40%-circle 25, is located downstream the pre-leading edge 31, seen in the direction of rotation of the pump 1/impeller 8, at least twenty percent of the distance between the pre-leading edge 31 and the trailing edge 27 taken perpendicular to said leading edge 26.

Thereby, the guide pin is provided with a stepwise configuration, seen in the circumferential direction, wherein solid matter will more easily be scraped off and captured by the feeding groove since the stepwise configuration constitute part of the inlet of the feeding groove.

According to various embodiments, at least one portion of an upper surface 30 of the guide pin 13 is a plane surface, said at least one portion being defined by the 15%-circle 23, the 85%-circle 24, the leading edge 26 and the trailing edge 27. In this preferred context the term plane surface means that any straight line joining any two points on the surface lies entirely on said surface. According to various embodiments, said at least one portion of the upper surface 30 of the guide pin 13 is tilted in relation to a horizontal plane, wherein the distal end of the guide pin 13 is located upstream the proximal end of the guide pin 13, seen in the axial direction. A plane upper surface of the guide pin entail that the axial gap between the leading edge of the blade of the impeller and upper surface of the guide pin, is kept uniform when the axial gap is trimmed. I.e. the distance between the surfaces taken normal to said surfaces is uniform when the mutual axial location of the impeller and impeller seat is altered/trimmed/adjusted.

From the proximal end of the guide pin 13 towards the distal end of the guide pin 13, the guide pin 13 has a decreasing height, and the under surface of the guide pin 13 is rounded, in order to prevent solid matter from getting stuck on the underside of the guide pin 13. It is also plausible to have the upper surface 30 of the guide pin 13 bent/curved upstream or downstream in order to follow a corresponding shape of the leading edge of the blade 17 of the impeller 8, wherein the upper surface 30 is still a plane surface. The leading edge 18 of the blade 17 is preferably located in a horizontal plane, or in a conical plane wherein the inner part of the leading edge is displaced in the upstream direction. The pre-leading edge 31 and the leading edge 26 are connected via an intermediate surface 32, wherein the intermediate surface 32 may be curved or plane or combination thereof.

The distance, i.e. the gap height, between the leading edge 18 of the blade 17 and the upper surface 30 of the guide pin 13 is equal to or more than 0.05 mm and equal to or less than 1 mm, preferably equal to or more than 0.1 mm and equal to or less than 0.5 mm. The same applies to the distance between the upper surface 12 of the impeller seat 5 and the lower edge 20 of the blade 17.

Thereby the solid matter located between the leading edge of the guide pin 13 and the leading edge of the blade 17 will be scraped off outwards upon normal operation of the pump 1, i.e. forward rotation of the impeller 8. Thus, said range will promote scraping off solid matter at the interface between the leading edge of the blade 17 and the leading edge of the guide pin 13, and between the lower edge of the blade 17 and the feeding groove 14.

A downstream edge 33 of the feeding groove 14, seen in the direction of rotation of the pump 1, is connected to the leading edge 26 of the guide pin 13 at the inlet of the feeding groove 14. The intermediate surface 32 is connected to the bottom surface of the feeding groove 14, i.e. the feeding groove starts in the guide pin 13.

There is a difference between the first embodiment of the impeller seat 5 and the second embodiment of the impeller seat 5. According to the first embodiment the guide pin 13 is angled in relation to a radius of the impeller seat 5, and according to the second embodiment the distal end of the guide pin 13 is pointing towards the centre of the impeller seat 5. Thus, according to the first embodiment of the impeller seat 5, the distal end of the guide pin 13 is located upstream the proximal end of the guide pin 13, seen in the direction of rotation of the impeller 8, clockwise in FIGS. 3-7. According to the first embodiment the solid matter at the leading edge 18 of the blade 17 is more easily scraped off.

Reference is now made to FIGS. 5 and 6, in order to further define the design and cooperation of the guide pin 13 and the feeding groove 14. The new design is defined using a groove inlet upstream edge line 34 that is a radius of the impeller seat 5 intersecting an upstream edge 35 of the feeding groove 14 at said circular intersection 11 and a groove inlet downstream line 36 is a radius of the impeller seat 5 intersecting a downstream edge 33 of the feeding groove 14 at said circular intersection 11, seen in the direction of rotation of the pump 1. It shall be pointed out that an upstream edge of the guide pin 13 is constituted by the leading edge 26 and/or the pre-leading edge 31, whichever is located most upstream, seen in the direction of rotation of the pump 1, i.e. the direction of rotation of the impeller 8. According to various embodiments of the present invention, the downstream edge 33 of the inlet of the feeding groove 14, seen in the direction of rotation of the pump 1, is connected to the leading edge 26 of the guide pin.

According to various embodiments the upstream edge 35 of the groove inlet is located upstream a radius of the impeller seat 5 intersecting an upstream edge of the guide pin 13 at the 15%-circle 23, seen in the direction of rotation of the pump 1. According to various embodiments, the most upstream point of the upstream edge 35 of the feeding groove 14, seen in the direction of rotation of the pump 1, is located at the groove inlet upstream edge line 34.

According to various embodiments a groove inlet upstream edge angle (A) between a radius of the impeller seat 5 intersecting an upstream edge of the guide pin 13 at the 15%-circle 23, seen in the direction of rotation of the pump 1, and the groove inlet upstream edge line 34, is equal to or less than 30 degrees and equal to or more than 0 degrees. Thereby, the inlet of the feeding groove 14 is smaller and the back flow into the inlet of the impeller seat 5 considerably reduced or avoided.

According to various embodiments, the downstream edge 33 of the groove inlet is located downstream a radius of the impeller seat 5 intersecting an upstream edge of the guide pin 13 at the 15%-circle 23, seen in the direction of rotation of the pump 1. A groove inlet downstream edge angle (T) between the radius of the impeller seat 5 intersecting the upstream edge of the guide pin at the 15%-circle 23, seen in the direction of rotation of the pump 1, and the groove inlet downstream edge line 36 is more than 0 degrees and equal to or less than 30 degrees.

According to various embodiments, the radially inner most part of the guide pin 13 is located radially outside the hub 16 of the impeller 8. Thereby, solid matter may not be trapped between the hub 16 of the impeller 8 and the upper surface 30 of the guide pin 13, and solid matter raked off inwards during reverse operation of the pump 1 will more easily leave the guide pin 13.

Feasible Modifications of the Invention

The invention is not limited only to the embodiments described above and shown in the drawings, which primarily have an illustrative and exemplifying purpose. This patent application is intended to cover all adjustments and variants of the preferred embodiments described herein, thus the present invention is defined by the wording of the appended claims and thus, the equipment may be modified in all kinds of ways within the scope of the appended claims.

It shall also be pointed out that all information about/concerning terms such as above, under, upper, lower, etc., shall be interpreted/read having the equipment oriented according to the figures, having the drawings oriented such that the references can be properly read. Thus, such terms only indicate mutual relations in the shown embodiments, which relations may be changed if the inventive equipment is provided with another structure/design.

It shall also be pointed out that even thus it is not explicitly stated that features from a specific embodiment may be combined with features from another embodiment, the combination shall be considered obvious, if the combination is possible.

The invention claimed is:

1. A hydraulic unit of a pump configured for pumping liquid comprising solid matter, the hydraulic unit comprising:

a housing defining a volute and an impeller seat located in the volute;

the housing having an axial inlet opening and an outlet opening, the impeller seat having an axial inlet defined by an inlet wall, the impeller seat having an inlet radius (R) measured from an axially extending centre axis (A) to a circular intersection between the inlet wall and an upper surface of the impeller seat; and the impeller seat comprising a guide pin connected to and extending radially inwards from the inlet wall;

the guide pin having a tip radius (r) measured from an axially extending centre axis (A) to a radially innermost part of the guide pin, and the housing comprising a cut water, an imaginary 15%-circle offset radially inwards from the circular intersection fifteen percent of the difference between the inlet radius (R) and the tip radius (r);

a cut water line defined by a radius of the impeller seat tangent to a most downstream point of the cut water, viewed in a direction of rotation of the pump, the cut water line located downstream a radius of the impeller seat perpendicular to the outlet opening, viewed in the direction of rotation of the pump; and a guide pin angle (μ) between the cut water line and a radius of the impeller seat intersecting a leading edge of the guide pin at the imaginary 15%-circle, viewed in the direction of rotation of the pump, is equal to or more than 3 degrees and equal to or less than 25 degrees.

2. The hydraulic unit of claim 1, wherein a cut water line angle (α) between the cut water line and the radius of the impeller seat perpendicular to the outlet opening, viewed in the direction of rotation of the pump, is more than 0 degrees and equal to or less than 20 degrees.

3. The hydraulic unit of claim 1, wherein the impeller seat comprises a feeding groove arranged in the upper surface of the impeller seat and extending from the inlet wall to the periphery of the impeller seat.

4. The hydraulic unit of claim 3, wherein the feeding groove has a groove inlet at the inlet wall of the impeller seat, the groove inlet having a first upstream edge at the circular intersection, wherein the first upstream edge of the groove inlet is located upstream a first radius of the impeller seat intersecting a second upstream edge of the guide pin at the imaginary 15%-circle, viewed in the direction of rotation of the pump.

5. The hydraulic unit of claim 4, wherein:

a groove inlet upstream edge line is a second radius of the impeller seat intersecting the upstream edge of the feeding groove (14);

a groove inlet upstream edge angle (λ) between the radius of the impeller seat intersecting the second upstream edge of the guide pin at the imaginary 15%-circle, viewed in the direction of rotation of the pump, and the groove inlet upstream edge line is equal to or more than 0 degrees and equal to or less than 30 degrees.

6. The hydraulic unit of claim 3, wherein the feeding groove has a groove inlet at the inlet wall of the impeller seat, the groove inlet having a downstream edge at the circular intersection, wherein the downstream edge of the groove inlet is located downstream a radius of the impeller seat intersecting an upstream edge of the guide pin at the imaginary 15%-circle, viewed in the direction of rotation of the pump.

7. The hydraulic unit of claim 1, wherein the guide pin angle (μ) is equal to or more than 3 degrees and equal to or less than 20 degrees.

8. The hydraulic unit of claim 1, wherein the guide pin angle (μ) is equal to or more than 3 degrees and equal to or less than 15 degrees.

9. The hydraulic unit of claim 1, wherein an imaginary 40%-circle is offset radially inwards from the circular intersection forty percent of the difference between the inlet radius (R) and the tip radius (r), wherein the guide pin comprises a leading edge configured for scraping off pollutants from an impeller of the pump, and wherein the guide pin, at least between the inlet wall and the imaginary 40%-circle, comprises a pre-leading edge located upstream the leading edge of the guide pin, viewed in the direction of rotation of the pump and viewed in an axial direction.

10. The hydraulic unit of claim 9, wherein an axial distance between the pre-leading edge and the leading edge of the guide pin is more than 1 mm and equal to or less than 4 mm.

11. Pump for pumping liquid comprising solid matter, the pump comprising:

an open impeller having a cover plate;

a centrally located hub; and at least two spirally swept blades connected to the cover plate and to the hub, each blade of the at least two spirally swept blades of the impeller comprising:

a leading edge adjacent the hub, a trailing edge at the periphery of the impeller, and a lower edge, the lower edge extending from the leading edge to the trailing edge and separating a suction side of the blade from a pressure side of the blade; and the hydraulic unit of claim 1, the leading edge of a first blade of the at least two spirally swept blades configured to cooperate with the guide pin of the impeller seat during operation of the pump and the lower edge of the first blade located opposite the upper surface of the impeller seat.

12. The pump of claim 11, wherein the impeller is displaceable back and forth in an axial direction in relation to the impeller seat during operation of the pump.

13. The pump of claim 11, wherein the radially innermost part of the guide pin is located radially outside the hub of the impeller.

14. The pump of claim 11, wherein a gap between the leading edge of the first blade of the impeller and the upper surface of the guide pin is equal to or more than 0.05 mm and equal to or less than 1 mm.

* * * * *